US011179750B2

(12) United States Patent
Philipp

(10) Patent No.: US 11,179,750 B2
(45) Date of Patent: Nov. 23, 2021

(54) VIBRATION PISTON ARRANGEMENT IN THE SQUEEZING CYLINDER OF A TRACK TAMPER

(71) Applicant: PLASSER & THEURER EXPORT VON BAHNBAUMASCHINEN GESELLSCHAFT M.B.H., Vienna (AT)

(72) Inventor: Thomas Philipp, Leonding (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 897 days.

(21) Appl. No.: 15/767,557

(22) PCT Filed: Oct. 24, 2016

(86) PCT No.: PCT/EP2016/001761
§ 371 (c)(1),
(2) Date: Apr. 11, 2018

(87) PCT Pub. No.: WO2017/088943
PCT Pub. Date: Jun. 1, 2017

(65) Prior Publication Data

US 2018/0297081 A1 Oct. 18, 2018

(30) Foreign Application Priority Data

Nov. 24, 2015 (AT) ..... A 758/2015

(51) Int. Cl.
*B06B 1/18* (2006.01)
*E01B 27/17* (2006.01)
*E01B 27/16* (2006.01)
*F15B 21/14* (2006.01)

(52) U.S. Cl.
CPC ..... *B06B 1/18* (2013.01); *E01B 27/16* (2013.01); *E01B 27/17* (2013.01); *E01B 2203/12* (2013.01); *F15B 21/14* (2013.01)

(58) Field of Classification Search
CPC . B06B 1/18; E01B 27/16; E01B 27/17; E01B 27/18; E01B 27/20; E01B 2203/12; F15B 21/14
See application file for complete search history.

(56) References Cited

U.S. PATENT DOCUMENTS 4,096,806 A 6/1978 Allmer
9,957,668 B2 * 5/2018 Lichtberger ..... E01B 27/16
(Continued)

FOREIGN PATENT DOCUMENTS

AT 352167 B 9/1979
CN 201068907 Y 6/2008
CN 102691690 A 9/2012
(Continued)

*Primary Examiner* — Jason C Smith
(74) *Attorney, Agent, or Firm* — Laurence A. Greenberg; Werner H. Sterner; Ralph E. Locher

(57) ABSTRACT

For tamping a track, tamping tines are squeezed towards one another in pairs by a squeezing cylinder. A vibration is superimposed on a linear lift motion of a squeezing piston movable in the squeezing cylinder. The vibration is generated by a vibration piston which is arranged in the squeezing cylinder and which is movable independently of the squeezing piston.

19 Claims, 2 Drawing Sheets

(56) References Cited

U.S. PATENT DOCUMENTS

| | | | | |
|---|---|---|---|---|
| 2012/0240565 | A1* | 9/2012 | Schnabel | F16H 61/30 60/327 |
| 2018/0297081 | A1* | 10/2018 | Philipp | E01B 27/17 |

FOREIGN PATENT DOCUMENTS

| | | | |
|---|---|---|---|
| CN | 104405692 | A | 3/2015 |
| CN | 105020198 | A | 11/2015 |
| DE | 1232605 | B | 1/1967 |
| EP | 0331956 | A2 | 9/1989 |
| EP | 2770108 | A1 | 8/2014 |
| GB | 994905 | A | 6/1965 |
| GB | 1557314 | A | 12/1979 |

* cited by examiner

Fig. 3
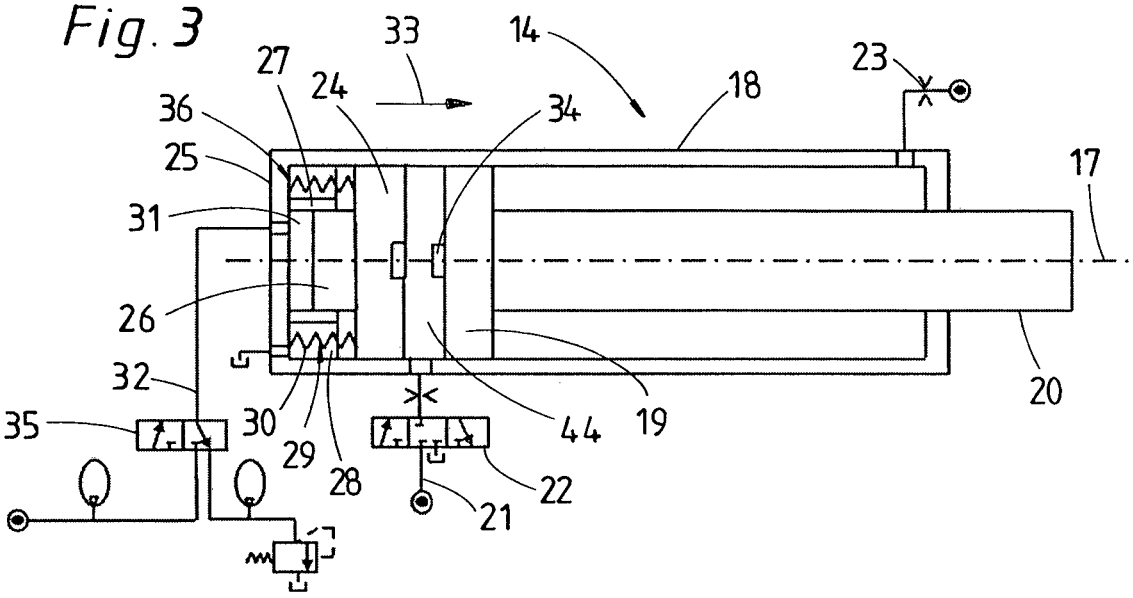
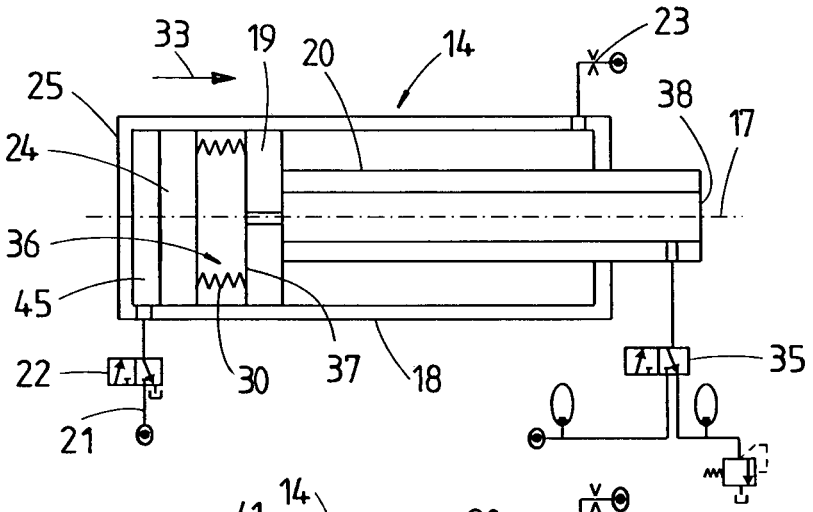
Fig. 4
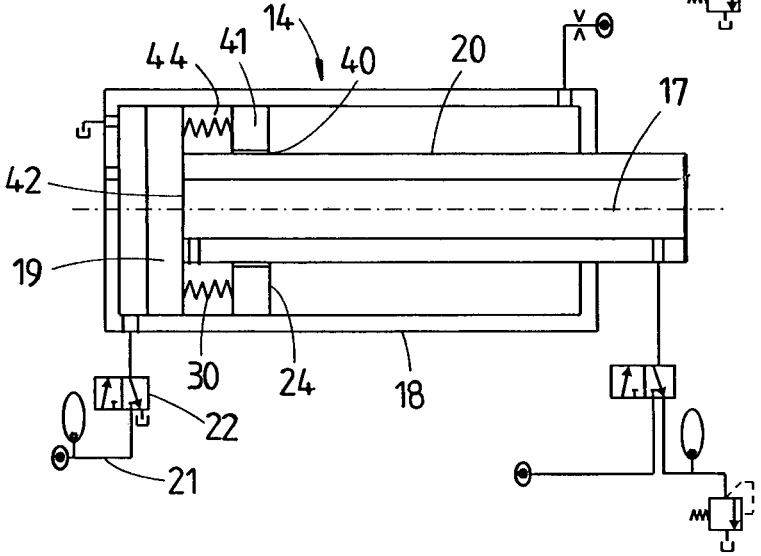
Fig. 5

VIBRATION PISTON ARRANGEMENT IN THE SQUEEZING CYLINDER OF A TRACK TAMPER

BACKGROUND OF THE INVENTION

Field of the Invention

The invention relates to a method and a tamping unit for tamping a track. The method is carried out with tamping tines that are squeezable towards one another in pairs by means of a squeezing cylinder. A vibration is superimposed on a linear lift motion of a squeezing piston movable along an axis in the squeezing cylinder. The tamping unit for tamping a track has tamping levers which are movable towards one another in pairs about a pivot axis in a squeezing motion and are connected at a lower end to tamping tines. The tamping levers are connected at an upper end to a hydraulic squeezing drive designed for carrying out the squeezing motion and the vibration superimposed thereon.

A tamping unit of this type is known from EP 1 653 003 A1, wherein, for tamping a track, tamping tines are moved towards one another in pairs. This squeezing motion for ballast compaction is carried out with the aid of a hydraulically actuatable squeezing cylinder. A vibration is superimposed hydraulically on the linear squeezing motion in order to thus achieve easier penetration into the ballast as well as improved compaction.

SUMMARY OF THE INVENTION

It is the object of the present invention to provide a method and a tamping unit of the kind mentioned at the beginning with which it is possible to improve the hydraulic generating of vibrations.

According to the invention, this object is achieved with a method or a tamping unit of the specified type by means of the features as claimed.

With the combination of features according to the invention, an optimisation of the parameters required for the generation of vibrations is possible independently of the squeezing motion of the tamping tines. An improvement particularly with regard to the energy balance can be achieved if the vibration piston is effective as a spring-mass system. Using such an energy store, it is possible to significantly reduce the high hydraulic energy expenditure intrinsically required for generating vibrations. A further advantage resulting therefrom can be seen in reduced noise emission.

Additional advantages of the invention become apparent from the dependent claims and the drawing description.

BRIEF DESCRIPTION OF THE SEVERAL VIEWS OF THE DRAWING

The invention will be described in more detail below with reference to an embodiment represented in the drawing.

DESCRIPTION OF THE INVENTION

Figure 1:
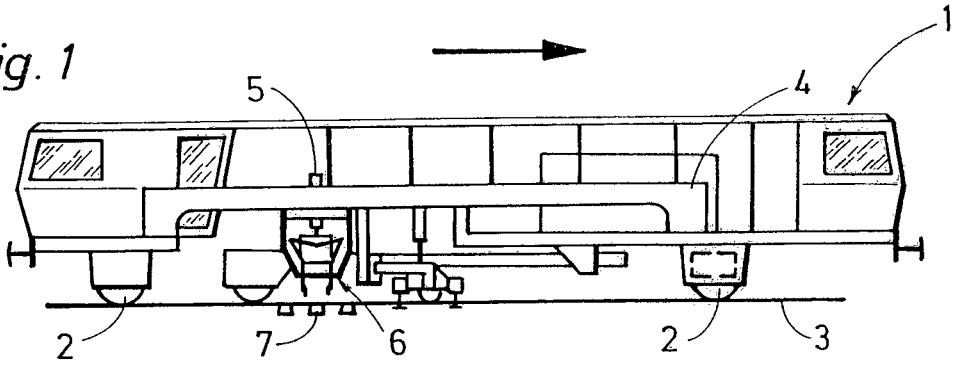
FIG. 1 shows a simplified side view of a tamping machine having a tamping unit for tamping a track.

A tamping machine 1, visible in FIG. 1, has a machine frame 4 mobile on a track 3 by means of on-track undercarriages 2. Arranged between the two on-track undercarriages 2 is a tamping unit 6, vertically adjustable by a drive 5, for tamping sleepers 7.

Figure 2:
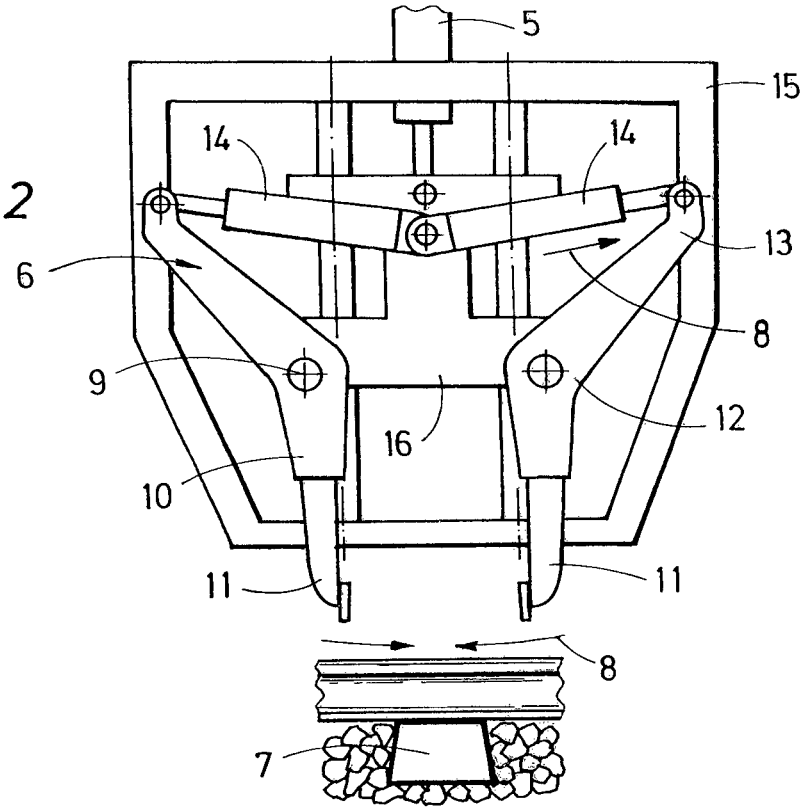
FIG. 2 is an enlarged representation of a tamping unit comprising squeezing drives, and FIGS. 3 to 6 each show a variation of embodiment of a squeezing drive designed according to the invention.

The tamping unit 6 shown enlarged in FIG. 2 has tamping levers 12 which, in a squeezing motion 8, are movable towards one another in pairs about a pivot axis 9 and are connected at a lower end 10 to tamping tines 11. At an upper end 13, said tamping levers 12 are connected in each case to a hydraulic squeezing drive 14 designed for carrying out the linear squeezing motion 8 as well as a vibration superimposed thereon. Both tamping levers 12 and the squeezing drives 14 are mounted on a carrier 16 which is vertically adjustable relative to an assembly frame 15 by the drive 5.

The squeezing drives 14, shown in detail in FIGS. 3 to 6, each have a squeezing piston 19, movable along an axis 17 of a squeezing cylinder 18, and a squeezing piston rod 20 connected thereto. In the version shown, these are moved hydraulically from left to right in each case for carrying out the linear squeezing motion 8 (see the hydraulic lines 21 with a valve 22 or a pressure relief valve 23.

Arranged in each squeezing drive 14 or squeezing cylinder 18, in addition to the squeezing piston 19 provided for the squeezing motion 8, is a vibration piston 24 designed for generating the vibrations. This vibration piston 24, in the two variants according to FIGS. 3 and 4, is arranged in each case between the squeezing piston 19 and a cylinder bottom 25 of the squeezing drive 14.

As visible in FIG. 3, a piston rod 26 connected to the vibration piston 24 is arranged in a cylinder ring 27, fastened to the cylinder bottom 25, for displacement along the axis 17 of the squeezing cylinder 18. Arranged in cavities 28 of the cylinder ring 27 are energy stores 29 contacting the vibration piston 24, preferably mechanical springs 30 for exerting forces effective parallel to the axis 17.

An oil chamber 31—formed by the cylinder bottom 25, the cylinder ring 27 and the piston rod 26 of the vibration piston 24—can be charged with high pressure via a hydraulic line 32 for generating a first oscillatory motion 33. An end position damping 34 is arranged on the vibration piston 24 and/or on the squeezing piston 19.

By corresponding positioning of the valve 22 and actuation of an oil chamber 44 delimited by the squeezing piston 19 and vibration piston 24, the squeezing piston 19 together with the squeezing piston rod 20 is set in motion which, in the course of the squeezing motion 8, brings together the two tamping tines 11 lying opposite one another in pairs (see FIG. 2). The oscillation with constant amplitude, superimposed on this linear squeezing motion, is generated by the vibration piston 24 which is movable independently of the squeezing piston 19. The end position damping 34 prevents the vibration piston 24 and squeezing piston 19 from having abrupt contact.

Via the hydraulic line 32, the volume flow for the vibration, or rather for the first oscillatory motion 33, is led to the oil chamber 31. In this, the vibration is generated by means of a rapidly switching valve 35. Said valve 35 can switch through the high pressure side in impulse-like fashion, causing the vibration piston 24 to be shifted towards the right and the mechanical spring 30 to be tensioned.

With the valve 35 in zero position, a connection to a storage container is established. In this position, a swimming position is possible. In further sequence, the spring 30 can now reset the vibration piston 24 (with a movement in the direction towards the cylinder bottom 25), and the hydraulic oil is discharged into the storage container. Thus, the role of the energy store 29 is taken over by the mechanical spring 30 (alternatively, the energy store 29 may also have the form of a bubble storage or the like). Thus, the vibration piston 24 and the springs 30 form an energy conservation system 36 in the shape of a spring-mass system. Ideally, the system 36 is operated near the resonant frequency of the spring-mass system. With the pressure relief valve 23, a squeezing pressure for the squeezing motion and thus a dynamic counter cushion is built up.

The advantage of the described solution versus the known fully hydraulic squeezing drives lies in the fact that the vibratory motion can be carried out independently of the motion of the squeezing cylinder 19. It is generally known that, in the known hydraulic drive, as a result of the superimposition of the squeezing—and vibratory motion, the volume stream becomes so high that the structural size of the valve becomes unnecessarily large, and the entire volume stream of the superimposed vibration is transformed into heat. This leads to high energy consumption.

It is further known or proven by measurements that, in the case of heavy encrustation of the ballast to be tamped, the oscillation amplitude with a known fully hydraulic system cannot be maintained (avoiding this disadvantage is only possible by increasing the structural size). The reason for this lies in the fact that no energy can be stored in the system in the short term.

In contrast to the indicated disadvantages in the known embodiments, an energy store is available in the power concept according to the invention by means of the spring-mass system (formed by the springs 30 and the vibration piston 24). This corresponds energetically to the function of a rotating oscillating mass, known from the prior art, having an eccentric drive for producing a tamping tine vibration. Furthermore in an advantageous way, the squeezing motion can be carried out independently of the oscillation amplitude of the vibration. This results in a simplified design of the valve for the squeezing cylinder 18.

In the variant of embodiment according to FIG. 4, the vibration piston 24 is connected by the mechanical springs 30 to a piston surface 37 of the squeezing piston 19. In this, the springs 30 could also be left out. However, this would require a higher hydraulic pressure for producing the vibrations and thus diminish the degree of efficiency.

Figure 6:
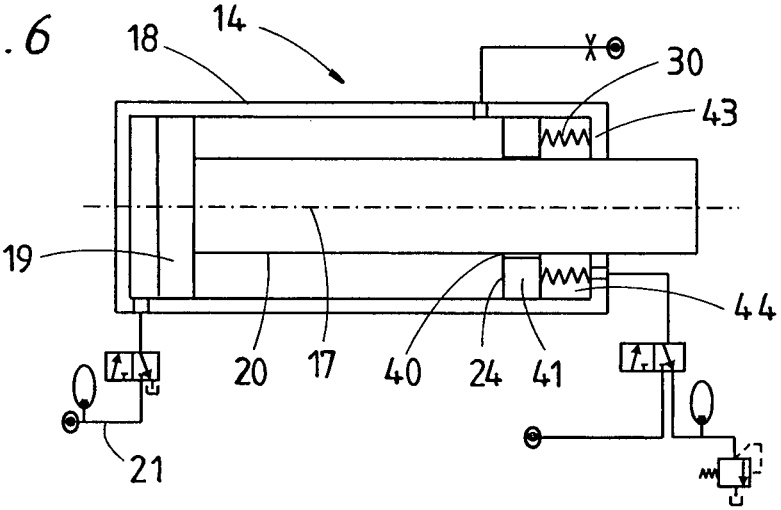

The squeezing piston 19 and the squeezing piston rod 20 connected thereto have a bore 38, preferably extending coaxially to the axis 17, for the passage of a vibration impulse generating the first oscillatory motion 33 of the vibration piston 24 (see also FIGS. 5, 6). The vibration is generated by the valve 35, wherein the two pistons 19, 24 are moved away from one another. The squeezing motion of the squeezing cylinder 19 is activated by the valve 22 and takes place in an oil chamber 45 (delimited by the vibration piston 24 and the cylinder bottom 25). The second oscillatory motion (opposed to the first) is activated in turn by the energy conservation system 36 composed of the vibration piston 24 and springs 30.

In the embodiments according to FIGS. 5 and 6, the vibration piston 24 is designed in each case as a ring 41 having an opening 40 for passage of the squeezing piston rod 20. The mechanical springs 30 connected to the vibration piston 24 are fastened to a piston surface 42 at the piston rod side of the squeezing piston 19 (see FIG. 5) or to a cylinder bottom 43 at the piston rod side of the squeezing cylinder 14 (see FIG. 6). The generation of vibrations takes place, like in the embodiment according to FIG. 4, in an oil chamber 44 delimited by vibration cylinder 24 and squeezing cylinder 19 and containing the springs 30.

Controlling or regulating the present invention is carried out by means of simple and robust sensors, and the required values for the controlling or regulating are determined by means of a model predictive system (observer). From known physical values which are easy to measure, or from the control values, the not-measured values of an observed reference system are determined.

The invention claimed is:

1. A method for tamping a track, the method comprising:

providing tamping tines and a squeezing cylinder configured to squeeze the tamping tines towards one another in pairs;

moving the tamping tines by way of a squeezing piston movable along an axis in the squeezing cylinder extending transversely to the tamping tines;

generating a vibration by a vibration piston arranged in the squeezing cylinder and movable independently of the squeezing piston; and superimposing the vibration generated by the vibration piston on a linear lift stroke of the squeezing piston.

2. The method according to claim 1, which comprises supporting the vibratory motions of the vibration piston with an energy conservation system composed of the vibration piston and an energy storage device.

3. The method according to claim 1, which comprises generating a first oscillatory motion by a pressure pulse acting upon the vibration piston, wherein with the motion of the vibration piston a mechanical spring, connected thereto and effective as an energy storage device, is relaxed.

4. The method according to claim 3, which comprises carrying out a return of the vibration piston in a second oscillatory motion directed opposite to the first oscillatory motion by a resetting force of the mechanical spring.

5. A tamping unit for tamping a track, the tamping unit comprising:

tamping levers mounted for movement about a pivot axis towards one another in pairs in a squeezing motion, said tamping levers having a lower end connected to tamping tines and an upper end connected to a hydraulic squeezing drive configured for carrying out the squeezing motion and a vibration superimposed thereon;

said squeezing drive having a squeezing cylinder extending between said tamping levers transversely to said tamping levers, said squeezing drive having a squeezing piston disposed in said squeezing cylinder for generating the squeezing motion and a vibration piston for generating the vibration.

6. The tamping unit according to claim 5, wherein said vibration piston is arranged between said squeezing piston and a cylinder bottom of said squeezing drive.

7. The tamping unit according to claim 5, which comprises a piston rod connected to said vibration piston, wherein said piston rod is arranged in a cylinder ring, fastened to the cylinder bottom, for displacement along an axis of said squeezing cylinder.

8. The tamping unit according to claim 7, which comprises energy storage device contacting said vibration piston and arranged in hollow spaces of said cylinder ring for exerting forces effective parallel to the axis.

9. The tamping unit according to claim 8, wherein said energy storage device are mechanical springs.

10. The tamping unit according to claim 5, wherein said cylinder bottom, said cylinder ring and said piston rod together define an oil chamber, and said oil chamber is charged via a hydraulic line with high pressure for generating a first oscillatory motion.

11. The tamping unit according to claim 5, which comprises an end position damper disposed on one or both of said vibration piston or said squeezing piston.

12. The tamping unit according to claim 5, which comprises mechanical springs connecting said vibration piston to a piston surface of said squeezing piston.

13. The tamping unit according to claim 5, wherein said squeezing piston and a squeezing piston rod connected to said squeezing piston are formed with a bore for passage of a vibration pulse generating a first oscillatory motion of said vibration piston.

14. The tamping unit according to claim 13, wherein said bore in said squeezing piston and said squeezing piston rod extends coaxially to the axis.

15. The tamping unit according to claim 13, wherein said squeezing piston and said vibration piston delimit an oil chamber for supplying the pressure pulse for generating vibrations.

16. The tamping unit according to claim 13, wherein said vibration piston and said cylinder bottom delimit an oil chamber provided for a squeezing motion of the tamping tines towards one another.

17. The tamping unit according to claim 5, wherein said vibration piston is a ring formed with an opening for passage of said squeezing piston rod.

18. The tamping unit according to claim 5, which comprises mechanical springs connected to said vibration piston and fastened to a piston surface at a piston rod side of said squeezing piston.

19. The tamping unit according to claim 5, which comprises mechanical springs connected to said vibration piston and fastened to a cylinder bottom at a piston rod side of said squeezing drive.

* * * * *